US006125987A

United States Patent [19]

Abe et al.

[11] Patent Number: 6,125,987

[45] Date of Patent: Oct. 3, 2000

[54] KEY-TYPE ELECTRONIC COIN SELECTOR

[75] Inventors: Hiroshi Abe; Hiroshi Otomo, both of Iwatsuki, Japan

[73] Assignee: Asahi Seiko Co., Ltd., Tokyo, Japan

[21] Appl. No.: 09/169,525

[22] Filed: Oct. 9, 1998

[30] Foreign Application Priority Data

Jul. 16, 1998 [JP] Japan ..... 10-234836

[51] Int. Cl.[7] ..... G07F 7/00; G07D 5/08

[52] U.S. Cl. ..... 194/213; 194/317

[58] Field of Search ..... 194/317, 318, 194/319, 210, 205, 213

[56] References Cited

U.S. PATENT DOCUMENTS

| | | | |
|---|---|---|---|
| 4,674,618 | 6/1987 | Eglise et al. | 194/210 |
| 5,191,957 | 3/1993 | Hayes | 194/318 |
| 5,462,149 | 10/1995 | Waine . | |

FOREIGN PATENT DOCUMENTS

| | | | |
|---|---|---|---|
| 4021772 | 9/1992 | Germany . | |
| 0602474 | 6/1994 | Germany . | |
| 2-48788 | 2/1990 | Japan | 194/317 |
| 9213789 | of 1997 | Japan . | |
| 0072189 | 2/1983 | United Kingdom . | |
| WO9746984 | 11/1997 | WIPO . | |
| WO9007755 | 12/1999 | WIPO . | |

*Primary Examiner*—Robert P. Olszewski
*Assistant Examiner*—Bryan Jaketic
*Attorney, Agent, or Firm*—Quirk & Tratos

[57] ABSTRACT

A coin selector is provided which is adapted to electronically sample coins and compare the sampling data to stored data for genuine coins. The stored data can be preset or can be acquired and stored in memory by using a key coin. Data stored determines if a key coin is authentic and if it is, places the selector processor in a condition to accept and store new or modified data for determining the authenticity of other coins.

8 Claims, 7 Drawing Sheets

START
51
INIT.
52
MODE ?
53
DATA ?
70
NO
YES
100Y ?
54
NO
YES
COUNT
55
DATA
56
=N ?
57
NO
YES
PROC.
58
STORE
59
INS ?
61
NO
YES
DET.
62
COMP.
63
GEN. ?
65
NO
YES
ON
66
SENSE ?
67
NO
YES
OFF
68
SIGNAL
69

START
51
INIT.
52
DATA PROD.
53
COMPARE
61
NO
GENUINE
65
NO
CLOSE GATE
68
SIGNAL OUTPUT
69
DATA PROD.
70
NO
=N?
57
PROCESS DATA
58

KEY-TYPE ELECTRONIC COIN SELECTOR

FIELD OF THE INVENTION

The present invention relates to devices for discriminating disc bodies such as coins or tokens.

BACKGROUND

Heretofore various coin selectors have been developed such as Japanese Patent Application No. 9-213789 previously filed by the assignee of the present application. These types of selectors as described cannot store and select various data relating to numerous coins, tokens or disc bodies collectively referred to herein as coins. In other words this type of selector cannot be simply changed into a selector to authenticate and accept other coins. Further there is a drawback that coin data is not secure and can be changed by unauthorized persons.

There is a need for a selector which can overcome the problems noted above.

SUMMARY OF THE INVENTION

There is therefor set forth according to the present invention an electronic coin selector having a housing defining a closed path for an inserted coin and means for directing a genuine coin along one path and a non-genuine coin along another path. The selector includes a data processor and a memory structure including stored data relating to at least one distinguishing characteristic of a genuine coin and data relating to at least one distinguishing characteristic of a key coin. For example the stored data may relate to the detected composition of the coin, the thickness and the diameter of a 500, 100, 50 and 10 Yen coins as well as data relating to the detectable characteristics of a chosen key coin. Means are provided for detecting the distinguishing characteristic(s) of each of said coins inserted into said housing and generating data signals in response thereto to said processor. The detecting means may be in the form of oscillating circuits adapted to produce data relating to the sought characteristic of the coin. The processor compares said data signals from the detector means to the data contained in the memory structure to determine whether the coin is genuine or is a key coin. If the coin is genuine, it is received and if the coin is not determined to be genuine it is rejected. In response to determining receipt of a genuine key coin, means are provided for reconfiguring the data structure to add to or change the coin data stored in the memory or to select from the data stored in memory to reconfigure the selector to determine the authenticity of other coins. The reconfiguring means may be by reprogramming the processor to, in response to detecting a key coin, receive said data signals relating to a distinguishing characteristic of another coin subsequently inserted into the housing and to store the data relating to said another coin in the memory structure to thereafter determine whether later inserted coins are genuine. Alternatively the processor may be pre-programmed to statistically process the data signals from the detecting means generated in response to repeated insertion of the another coin to form data relating to the distinguishing characteristic of the another coin and to store said data relating to the another coin in the memory to thereafter determine whether later inserted coins are genuine.

Accordingly the data of the selector for determining the authenticity of coins can be easily changed by using the key coin.

BRIEF DESCRIPTION OF THE DRAWINGS

These and other features and advantages of the present invention will be appreciated as the same becomes better understood with reference to the specification and claims and drawings wherein:

DESCRIPTION

Figure 1:
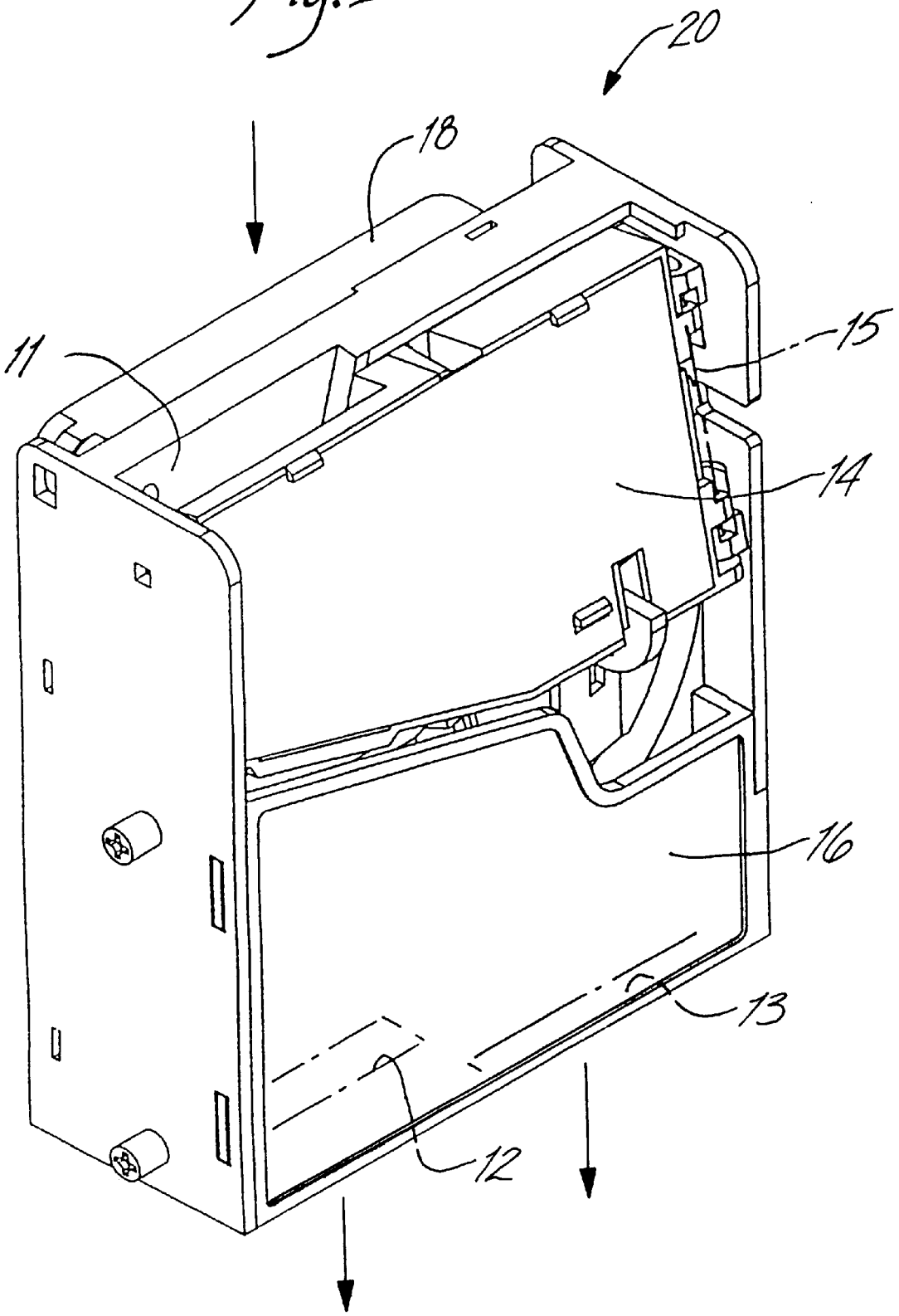
FIG. 1 is a perspective view showing a selector according to the present invention.

Turning to FIG. 1, a coin selector 20 according to one embodiment of the present invention is shown. The coin selector 20 is shaped as a slender box with the top of the selector provided with an insertion opening 11 to receive a coin, token or disc body (hereinafter collectively referred to as a coin) into the selector 20. At the bottom of the coin selector 20 is an opening 12 to pass a determined genuine coin from the selector 20 to, for example, a game machine or the like (not shown). Also at the bottom of the selector 20 is a return opening 13 for discharging a coin determined to not be genuine from the game machine.

On the upper part of the selector 20 is a trapezoid-shaped door 14 connected by a pivot axis 15 and usually maintained closed with a spring (not shown). Below the door 14 is a trapezoid-shaped cover 16 removably fixed to the selector 20.

The selector 20 also includes a J-shaped lever 18 which, when pushed downwardly, opens the door 14 to discharge a counterfeit coin from inside the selector 20 through the return opening 13.

The operation of the selector 20 will now be described.

Figure 2:
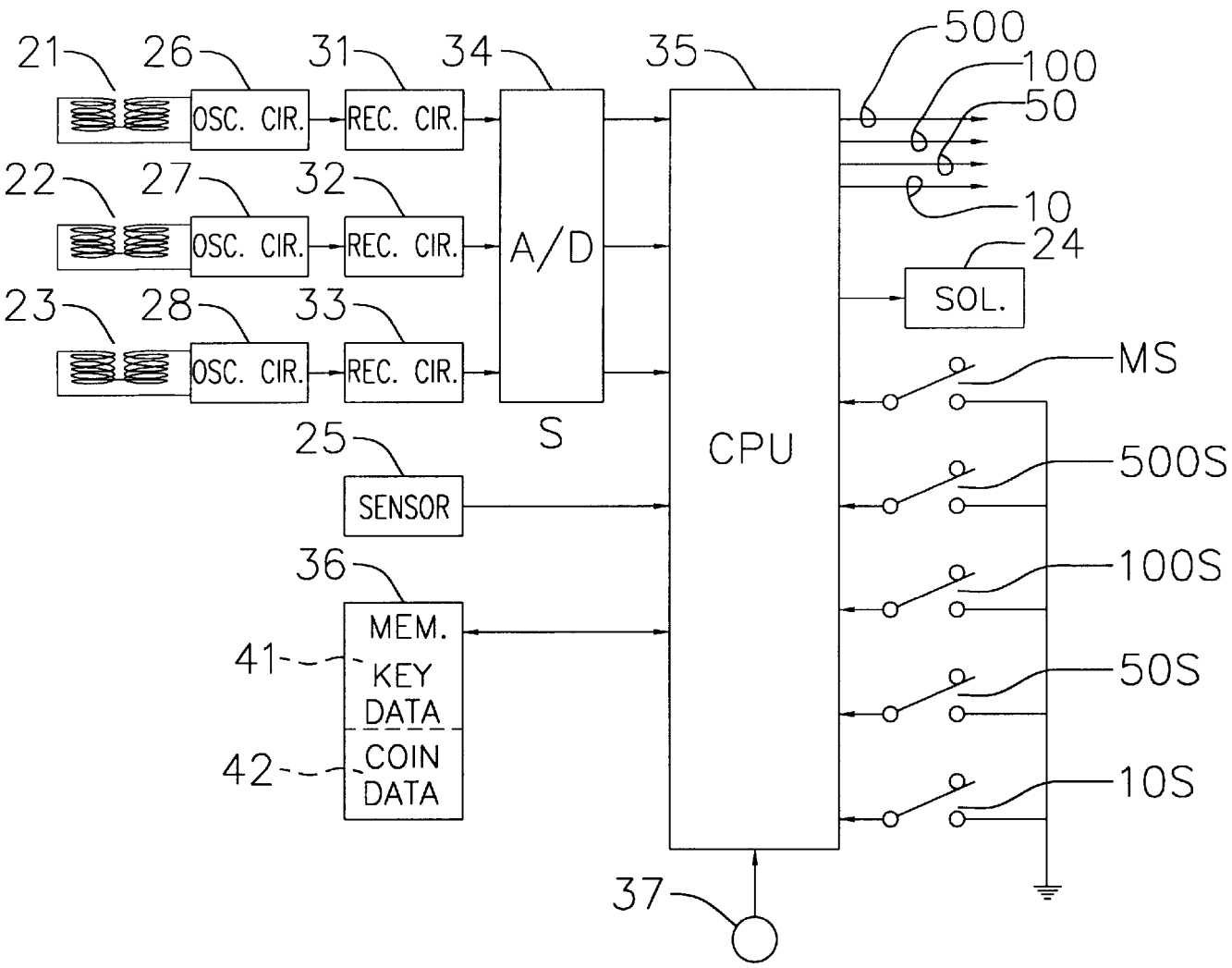
FIG. 2 is a block circuit diagram for the selector of FIG. 1.

First, the coin is inserted into opening 11 and drops through a diagonal path (not shown) formed inside the selector 20. The coin as it drops through the selector 20 is detected by pairs of coils 21,22 and 23 (FIG. 2) disposed in the upper part of the selector 20. The selector 20 thereby judges whether the inserted coin, by the circuit shown in FIG. 2, is genuine. When the coin is judged to be genuine, a solenoid 24 is placed into an on condition inside the lower part of the selector 20 which operates a gate in the diagonal path (not shown) to an open condition directing the genuine coin to drop through the opening 12 of the selector 20. The dropped genuine coin is contained in a cash box (not shown) for genuine coins installed inside a game machine or the like. In addition, at the time the genuine coin is passed, a signal S for detecting the passing of the genuine coin is output from a sensor 25 disposed in the selector 20 near the opening 12 to a processor 35 to place the solenoid 24 in an off condition to close the gate. When the inserted coin is judged to be not genuine, i.e., a counterfeit, the solenoid 24 does not operate to open the gate and thereby the diagonal path is continued to be placed in a closed position. Thereby the dummy coin drops from the return opening 13 to a lower path (not shown) to be discharged from the game machine.

With reference to FIG. 2, a block diagram of the electronic circuit in the selector 20 of FIG. 1 as shown. Coil pair 21 provides means to detect the material of the inserted coin and is connected to an oscillation circuit 26 operating at comparatively low frequency. Coil pair 22 provides a means for detecting a thickness of the coin and is connected to its oscillation circuit 27 operating at a comparatively high frequency. Coil pair 23 provides means for detecting the diameter of the coin and is connected to its oscillation circuit 28 operating at a comparatively high frequency. Each of the signals from the oscillation circuits 26–28 is rectified by rectifier circuits 31–33 respectively and at 34 is shown a circuit which converts the rectified analog signal from the rectifier circuits 31–33 to corresponding digital signals. The converting circuit 34 performs the sampling of the analog signal from each of the rectifier circuits 31–34, converts it to a digital signal and outputs each signal therefrom.

At 35 is shown a signal processing unit. Processing unit 35 is a central processing unit or microcomputer adapted to process the digital signals from the signal converter 34.

Also shown at FIG. 2 is a data structure or memory 36 adapted to store data such as key-coin data 41 which relates to a key-coin. The key data 41 is input into the processor 35 externally through an input terminal 37 to be stored in the memory 36. The key-coin as hereinafter described uses metals of silver, gold or a special alloy or a ferro-magnetic metal or the like. Furthermore, the memory 36 stores the various coin data 42 which relates to detection data for a genuine coin.

Also provided is a mode switch designated MS in FIG. 2 to switch the selection mode for the selector 20. The switch MS chooses either storing the coin data 42 in a memory 36 or operating the selector 20 according to the present invention.

With continuing reference to FIG. 2, a 500S switch is for setting the coin data 42 of a 500 Yen coin and storing that data in the memory 36. Similarly 100S is for setting the coin data 42 of a 100 Yen coin and for storing the data in a memory 36 and switch 50S is for setting the coin data 42 of a coin of 50 Yen and storing that data in the memory 36 and finally switch 10S is for setting the coin data 42 of a 10 Yen coin and storing that data in the memory 36.

With reference to the upper right-hand part of FIG. 2, are shown signals designated 500,100,50 and 10 illustrating signals sent by the processor 35 to the game machine upon receipt of corresponding denomination coins determined to be genuine.

Figure 3:
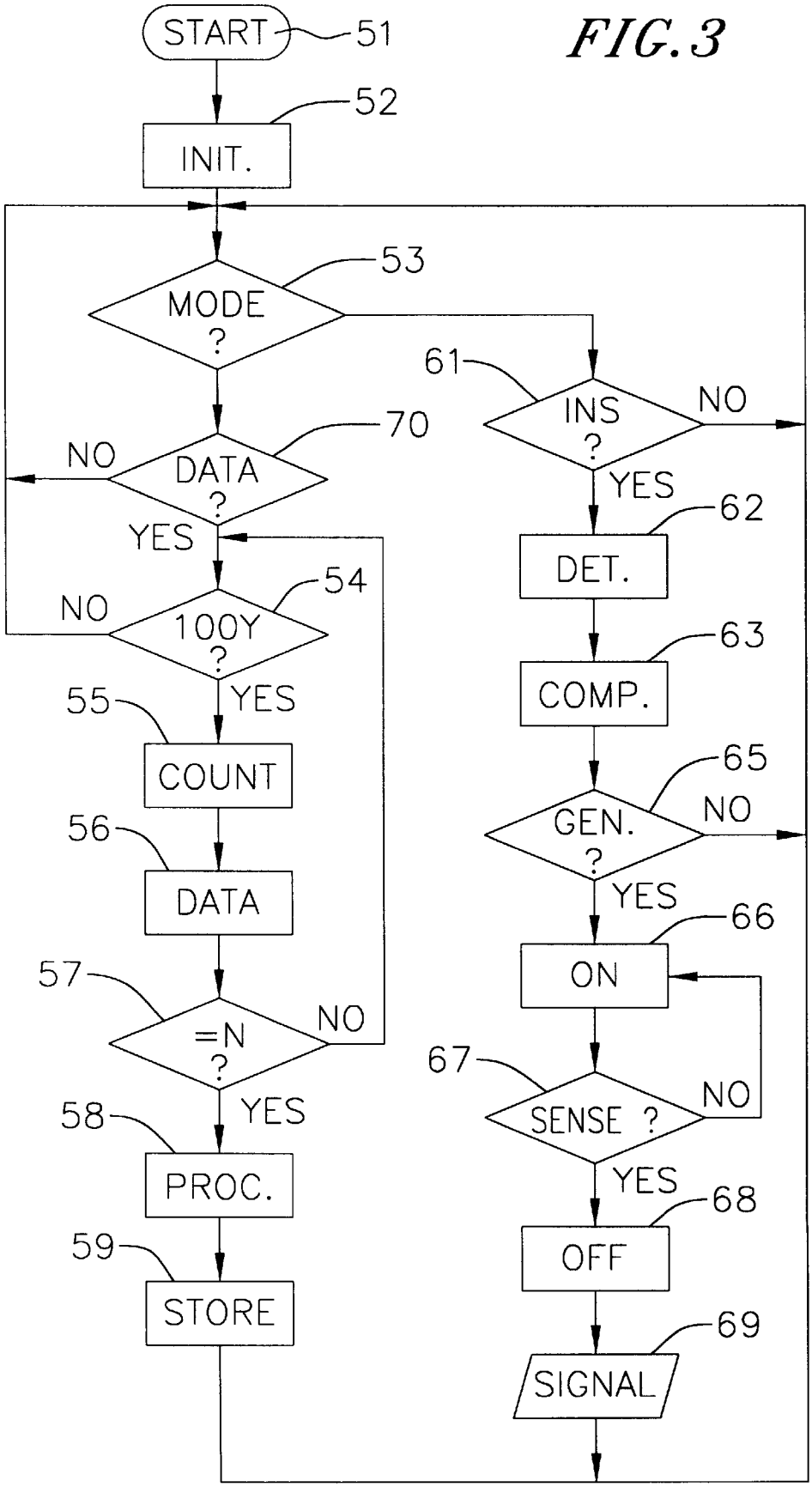
FIG. 3 is a logic flowchart diagram showing the operation of the selector.

Turning to FIG. 3, a flowchart for explaining the operation of the circuit of FIG. 2 is shown. When the power switch (not shown) of the selector 20 is switched on, the operation starts as shown at step 51. At the start of the operation, the initialization of the selector 20 is automatically performed at step 52. At initialization, the solenoid 24 is checked as is the sensor 25 to determine that they are operating normally and automatically. The remaining description will be directed to a case where the selector 20 is only used for 100 Yen coins.

In this example, the selection switch MS for the mode modification is closed to initialize the data production/memory mode of the selector 20. Next the coin-type setting switch 100S for coins of 100 Yen is chosen and closed. Therefore, if step 52 of the initialization has been completed data production mode will be chosen at step 53 of the mode confirmation.

In this configuration, if a key-type coin is inserted into the opening 11 of the selector 20 the data of the key coin and key data 41 stored in the memory 36 are compared by the processor 35. If the key-type coin is judged to be genuine, a data production mode will be performed at step 70. That is, if the coin of 100 Yen is inserted into the opening 11 (step 54), the insertion of the 100 Yen coin will be counted at step 55 and the sampling data of the inserted coin 100 Yen is obtained at step 56. The insertion of the genuine 100 Yen coin is continued through the opening 11 until the number of passes of the genuine coin reaches a predetermined number of coins N (step 57 to step 54). If the predetermined number of coins N is reached, the coin data 42 of a 100 Yen coin will be statistically processed by the processor 35 at step 58 and the derived coin data 42 is stored in the memory 36 at step 59. Thus the electronic coin selector can be used to choose the collector mode, i.e., the types of coins to be accepted after the above-mentioned steps.

If a coin is inserted into the opening 11 after the preparation at step 61, the data of the inserted coin will be compared by the detection means at step 62. The data is compared with the coin data 42 stored in the memory 36 at 63. When the sampling data of the inserted coin coincides with the coin data 42 of a coin of 100 Yen, it is judged that the coin is genuine at step 65 and the solenoid 24 is placed into an on condition at step 66 to accept the genuine coin. The genuine coin passes through the sensor 25 at step 67 and the solenoid 24 with its gate for receiving the genuine coin is placed in an off condition at step 68. The signal 100 for the genuine coin in FIG. 2 is simultaneously output at step 69 to the game machine for operation of the game.

Figure 4:
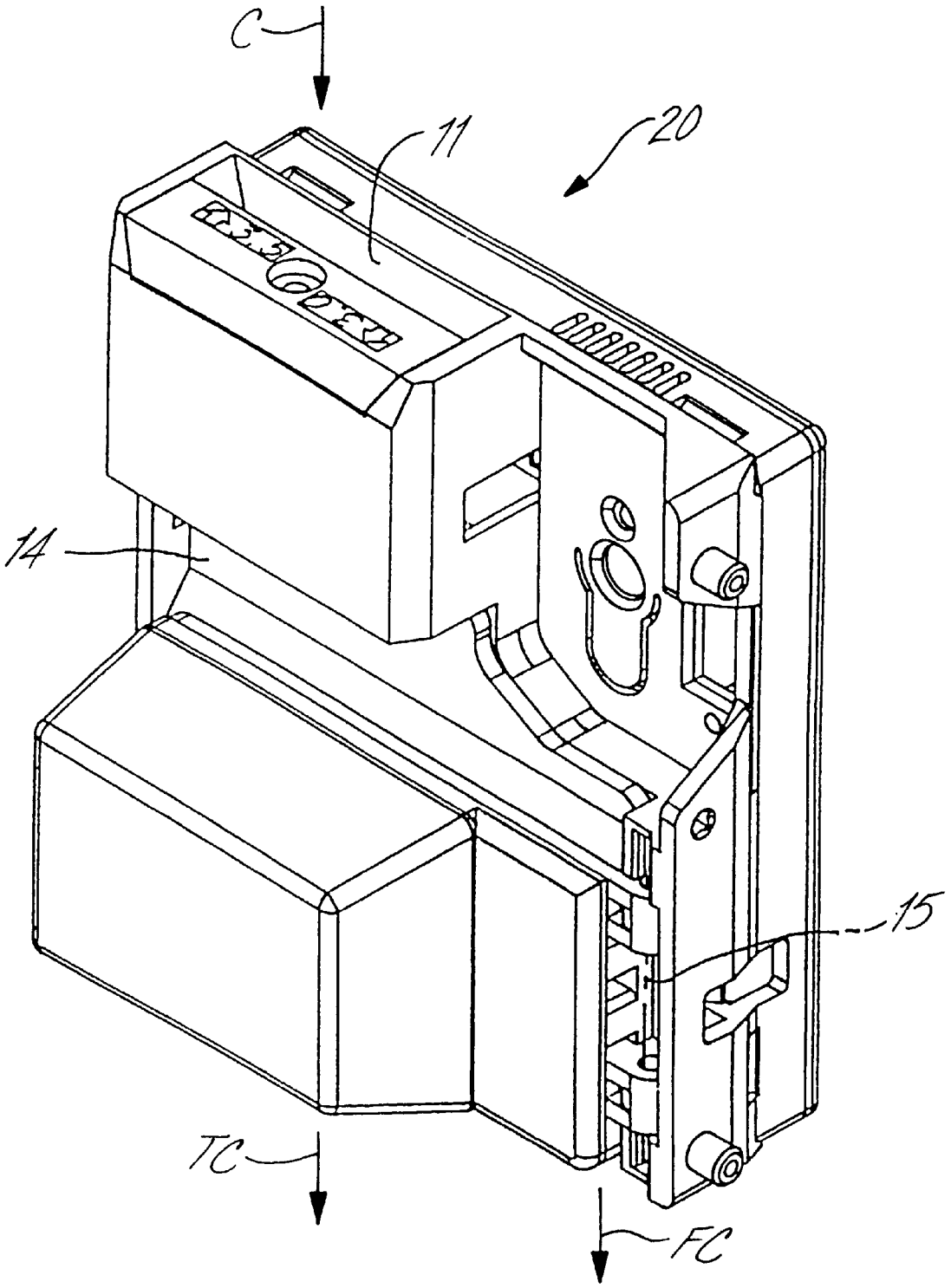
FIG. 4 is a perspective view of another embodiment of the selector according to the present invention.
Figure 5:
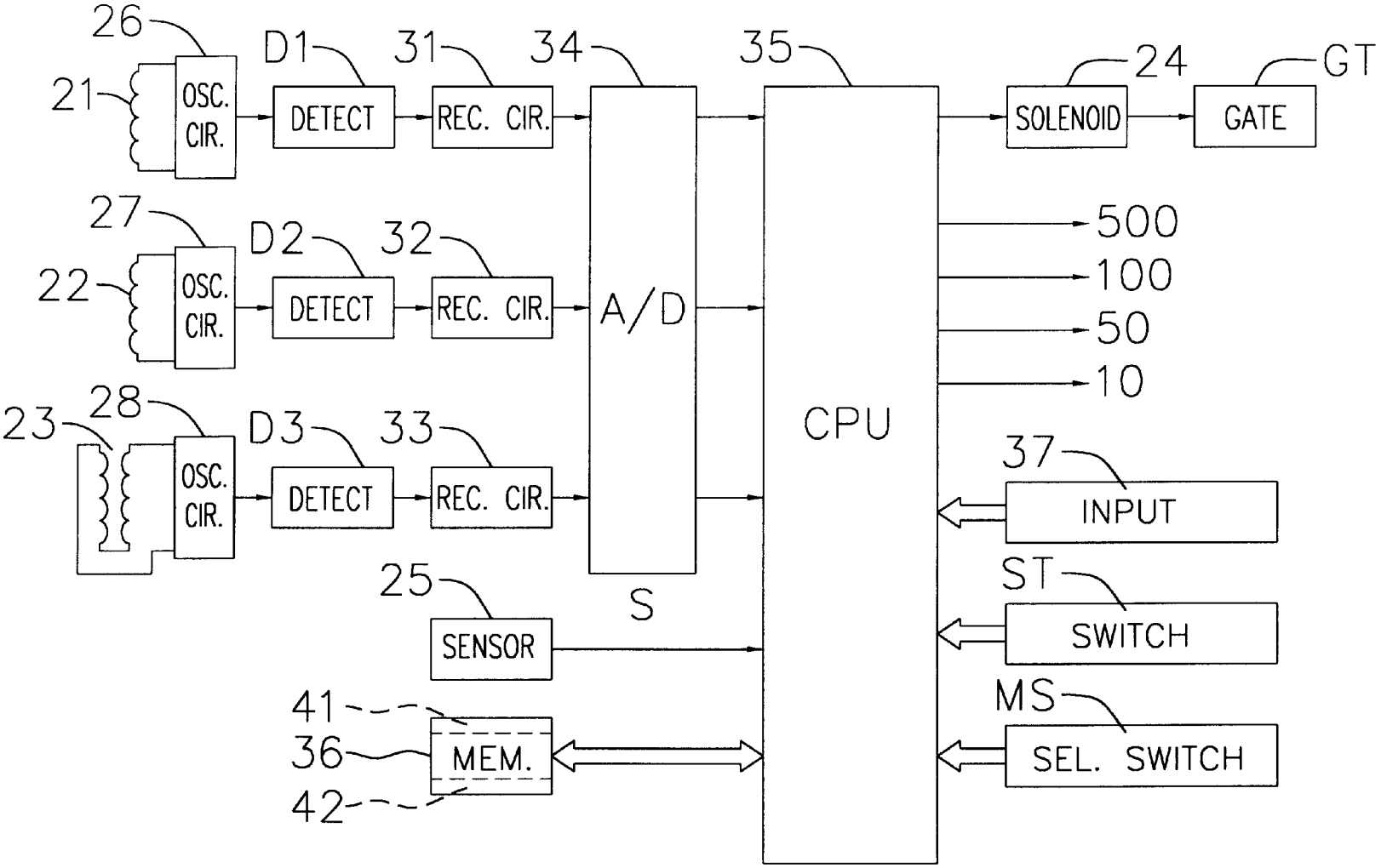
FIG. 5 is a block circuit diagram for the selector of FIG. 4.
Figure 6:
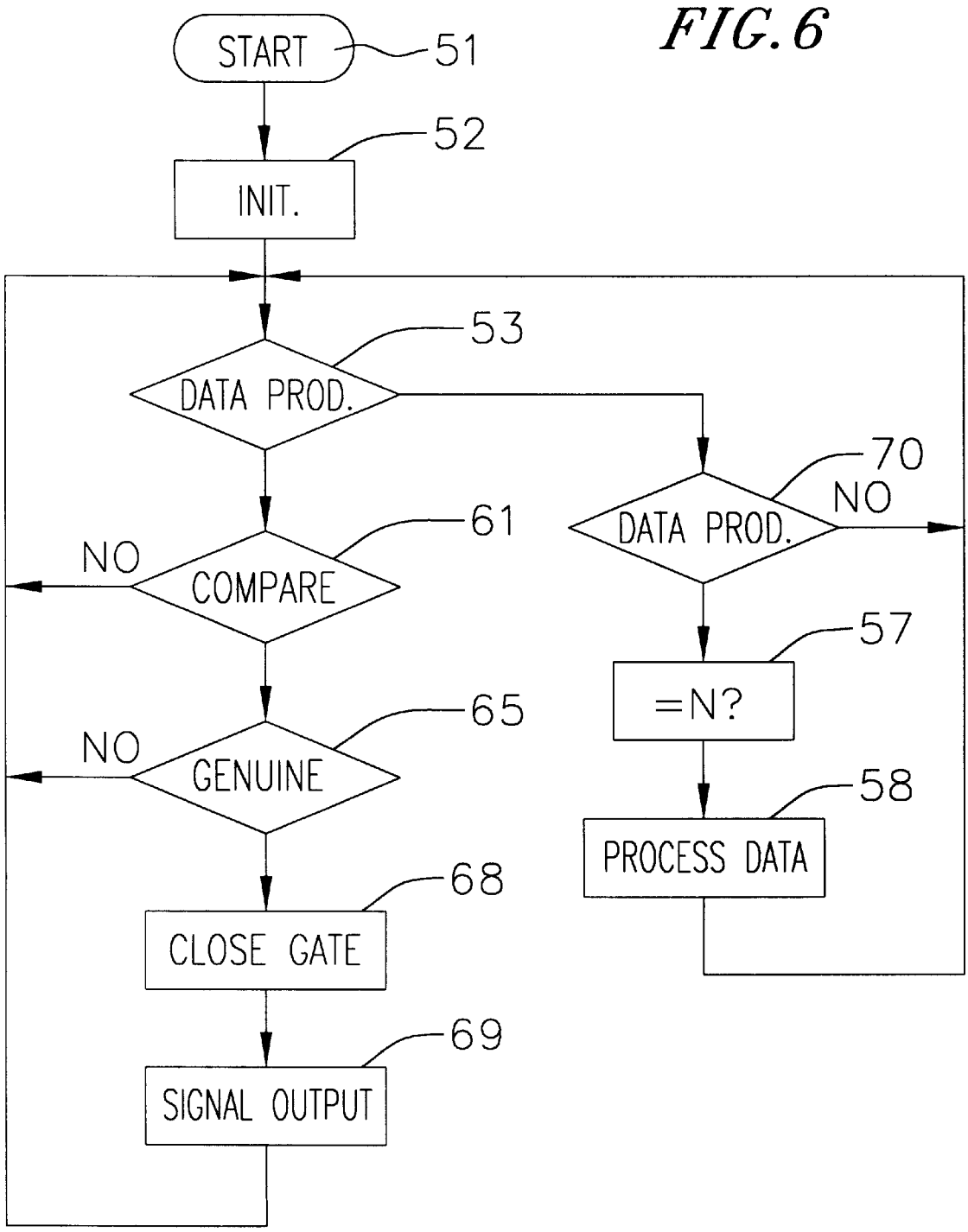
FIG. 6 is a logic diagram for the selector of FIG. 4.

Turning to FIG. 4 a further embodiment of the invention is shown. The same components bear the same reference numbers. FIG. 5 is a block circuit diagram of the selector 20 of FIG. 4 and FIG. 6 is a flowchart explaining the operation of the selector 20 of FIG. 4. The operation of the coin selector 20 of FIG. 4 is described as follows.

A coin C is inserted into opening 11 and drops through a perpendicular path (not shown) defined within the selector 20. Coin C is detected by three coils 21–23 (FIG. 5) arranged in the upper part of the selector 20. The detected coin C is judged, according to the block circuit diagram of FIG. 5 in the manner described above, to determine whether or not it is genuine. If the coin C is determined to be genuine, the solenoid 24 is controlled to be placed into an on position which opens a gate GT of the perpendicular path whereby the genuine coin TC drops perpendicularly and passes along an opening (not shown) of the selector 20 for collection thereof. The genuine coin TC dropping from the selector 20 is contained in a cash box (not shown) installed inside a game machine. In addition a signal S is output from the sensor 25 (FIG. 5) near the opening 11, that signal S placing the solenoid 24 in an off condition closing the gate GT of the perpendicular path.

When the inserted coin is judged to be not genuine, the solenoid 24 is not placed into an on position and for this reason the gate GT in the perpendicular path remains closed. Therefore the coin determined not to be genuine drops from a return opening (not shown) through a diagonal path as shown at FC.

With reference to FIG. 5 the block diagram of the electronic circuit for the selector 20 of FIG. 4 is shown. The coils 21–23 for detection respectively detect the material, thickness and diameter of the inserted coin C. In the manner described above, the coils 21–23 for the detection circuit are respectively connected to oscillation circuits 26–28. Each signal from the oscillation circuits 26–28 respectively is rectified by rectifier circuits 31–33 through detector circuits D1–D3. A converting circuit 34 performs the sampling of the analog signals from the rectifier circuits 31–33 and converts them into digital signals. The signal processing unit 35 processes the digital signals in the manner described above.

A memory 36 stores key-coin data 41 which relates to a key coin. The key-coin data 41 is input into the processor 35 from an external input terminal 37 for storage in the memory 36. Furthermore the memory 36 stores the various coin data 42 which relates to the characteristics of genuine coins.

A switch MS for selecting the mode of the selector 20 chooses whether the coin data 42 is either stored in memory 36 or is acquired by operation of the selector 20. Setting means ST for genuine coins includes a plurality of switches 500S, 100S, 50S and 10S (not shown) and as described above. The switch 500S is for setting the coin data 42 of a 500 Yen coin and storing the data in memory 36. Similarly switch 100S is for setting the coin data 42 of a coin of 100 Yen and storing the coin data 42 in memory 36, switch 50S is for setting the coin data 42 of a coin of 50 Yen and storing the same in memory 36, and switch 10S is for storing coin data 42 of a coin of 10 Yen in the memory 36.

The signal 500 in FIG. 5 is output from the processor 35 when the inserted coin C is determined to be a genuine 500 Yen coin. Signal 100 is similarly output when the inserted coin C is a genuine coin of 100 Yen, signal 50 is output when the inserted coin C is determined to be a genuine coin of 50 Yen, and signal 10 is output from the processor 35 when the inserted coin C is determined to be a genuine coin of 10 Yen denomination.

FIG. 6 is a flowchart explaining the operation of the circuit of FIG. 5. The power supply switch (not shown) of the selector 20 is switched on and the operation starts at step 51. When the start of the operation is performed, the initialization of the selector 20 is automatically performed at step 52. The following description describes the case where the selector 20 is used exclusively for a coin of 50 Yen denomination. In this case the mode modification selecting switch MS is chosen as the data acquisition/memory mode and the switch for a 50 Yen coin is selected at switch ST.

If step 52 of the initialization is completed, a data production mode will be chosen by step 53 of mode confirmation.

In the case described above, if a key-type coin is inserted into the insertion opening 11 of the selector 20, the acquired data of the key coin and key data 41 stored in memory 36 is compared by the processor 35. If the key-coin is judged to be genuine, a data production mode is executed at step 70. That is, if the coin of 50 Yen is inserted into the insertion opening 11, the inserted 50 Yen coin will be counted and the sampling data of a coin of 50 Yen coin will be obtained through the detection circuits. This operation is repeated until the 50 Yen coin is repeatedly inserted into the insertion opening 11 and the sum total of inserted coins reaches a predetermined number of coins at step 57. If the number of inserted coins reaches the predetermined number, the coin data 42 of the coin of 50 Yen will be statistically processed by the processor 35 at step 58 and stored in the memory 36 for subsequent comparison by the detection circuit and processor 35. After the above-mentioned steps, the electronic coin selector 20 is placed in the selector mode condition. Upon insertion of a coin, the sampling data from the detection coils 21–23 is compared with the stored coin data 42 in memory 36 at step 61. When the sampling data from the coils 21–23 coincides with the coin data 42 of a coin of 50 Yen stored in memory 36, the coin is judged to be genuine at step 65. When the coin is judged to be genuine the solenoid 24 gate GT is placed in an on condition and the determined genuine coin TC is dropped for collection thereof. The dropping genuine coin TC passes the sensor 25 and the solenoid 24 of gate GT is placed in an off condition to close the gate at step 68. The signal 50 for the genuine coin in FIG. 5 is output simultaneously at step 69 to the game machine.

The examples of the selector 20 of FIG. 1 and FIG. 4 explain the key-locking function of the selector 20 which relates to the data modification stored in the memory 36 relating it to genuine coins. However, the key-locking function of the electronic coin selector which uses a key-type coin according to this invention is not limited to the above examples. For example, the selector 20 may be adapted to store in memory the number of genuine coins accepted, time data or the like. The accumulation process for the number of coins and time data is performed for every output of a genuine coin and is stored in the memory 36. This data can be retrieved from the memory 36 only by using a key-type coin inserted in the selector 20 on the game machine. Consequently, one can investigate immediately what quantity of coins are in the coin box inside the game machine from an external display or the like.

As stated above, according to this invention, genuine coin data stored in the memory 36 of the selector 20 for other genuine coins can be obtained by inserting the key-type coin to place the selector 20 in a data acquisition mode and thereafter inserting genuine coins for data sampling and storage in memory. Unauthorized persons cannot change the genuine data of the selector 20. Authorized persons must use a key-type coin to change the data.

Figure 7:
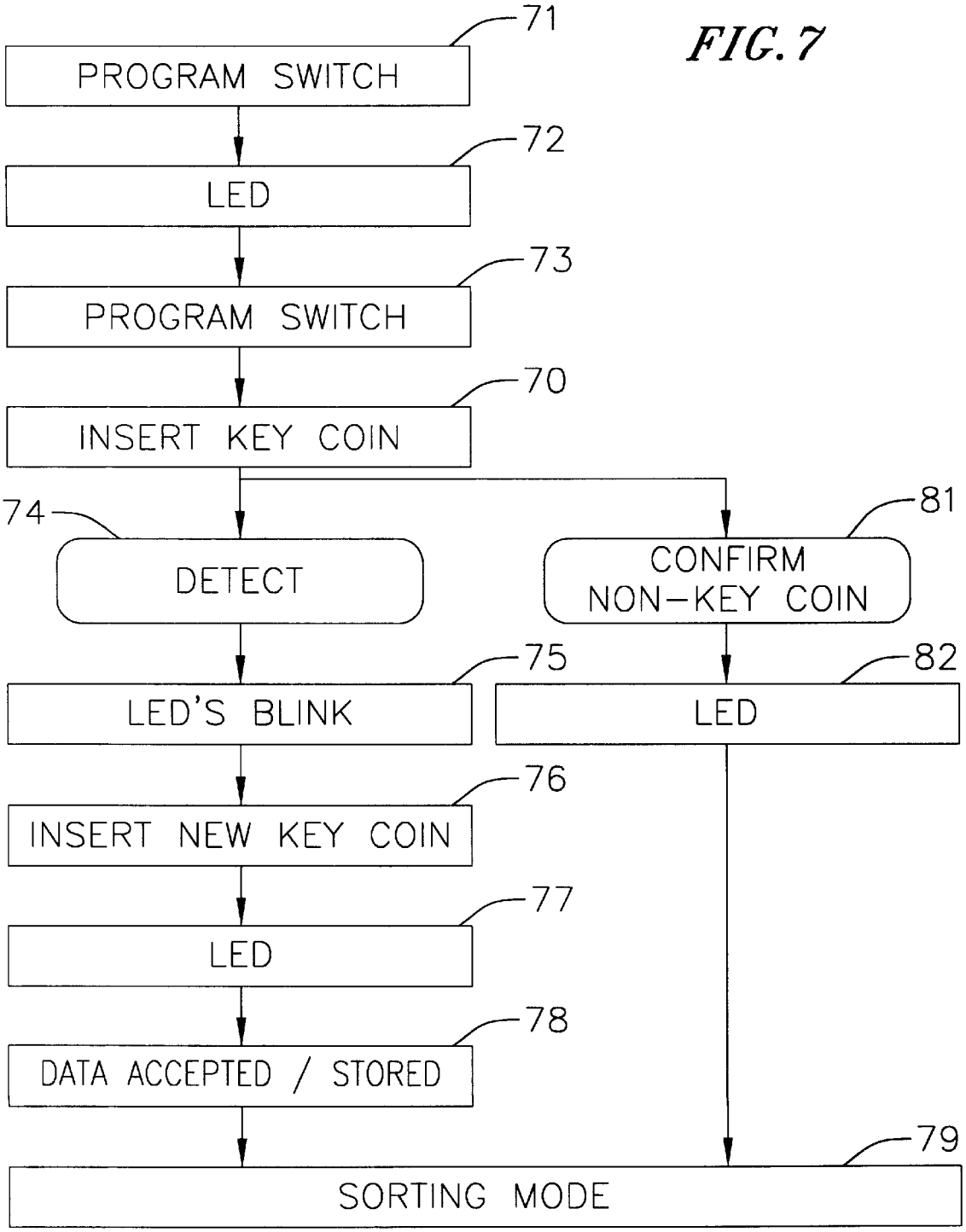
FIG. 7 is a flow diagram showing the operation of the selector of FIG. 4.

Turning to FIG. 7 is shown a flow diagram explaining other operations of the selector 20 of FIG. 5. According to this diagram, the data relating to the key coin data 41 concerning the key coin can be changed.

In step 71, a program switch, such as mode switching means MS and key-coin setting means 37 are placed in an on condition for at least more than a time period of 3 seconds. In step 72 an orange light-emitting diode (LED) on the housing of the selector 20 is driven to flash indicating the mode change. In step 73 the mode switching means MS and a key-type coin setting means 37 are turned off. At step 70 an authentic key-type coin is inserted into opening 11. At step 74 the detection means within the selector 20 as described above confirms whether the coin is inserted. Red and green LEDs blink alternatively in step 75 and a new key-type coin is inserted a plurality of times into the selector 20 at opening 11, for example, 4 times or 16 times at step 76. At step 77 a green LED on the exterior of the selector 20 lights indicating at step 78 that the data of the new key-type coin is accepted and stored in memory. At step 79 the selector 20 is switched back to the sorting mode and at step 81 it is confirmed that an inserted coin C is not registered as a key-type coin. Finally in step 82 a green LED on the exterior of the selector 20 lights indicating the selector is placed back into the coin sorting and counting mode.

While we have described certain embodiments of the present invention, it is to be understood that it is subject to many modifications without departing from the spirit and scope of the appended claims.

We claim:

1. An electronic coin selector having a housing defining a closed path for an inserted coin and means for directing a genuine coin along one path and a non-genuine coin along another path comprising:

a data processor;

a memory structure including data relating to at least one distinguishing characteristic of a genuine coin and data relating to at least one distinguishing characteristic of a key coin;

means for detecting the distinguishing characteristic of each of said coins inserted into said housing and generating data signals in response thereto to said processor, said processor comparing said data signals to the data contained in the memory structure to determine whether the coin is genuine or is a key coin; and said processor is pre-programmed to, in response to detecting a key coin, receive said data signals relating to a distinguishing characteristic of another coin subsequently inserted into the housing and to store said data relating to said another coin in said memory structure to thereafter determine whether later inserted coins are genuine another coins.

2. The selector of claim 1 wherein said processor is pre-programmed to statistically process said data signals from said detecting means generated in response to repeated insertion of said another coin to form data relating to said distinguishing characteristic of said another coin and to store said data relating to said another coin in said memory structure to thereafter determine whether later inserted coins are genuine another coins.

3. A coin selector comprising:

a processor;

a memory storing data relating to a plurality of distinguishing characteristics for a genuine coin and a key coin;

means for detecting the distinguishing characteristics of a coin and generating data signals corresponding to said detected characteristics, said processor adapted to receive said data signals and compare said detected data to said data stored in said memory to determine if a coin is genuine or is a key coin; and means for changing said data stored in said memory in response to detection of a key coin.

4. The selector of claim 3 wherein the means for changing data includes said processor preprogrammed to, in response to detection a key coin, receive said data signals relating to a distinguishing characteristic of another coin subsequently inserted into the housing and to store said data relating to said another coin in said memory structure to thereafter determine whether later inserted coins are genuine another coins.

5. The selector of claim 4 wherein said processor is pre-programmed to statistically process said data signals from said detecting means generated in response to repeated insertion of said another coin to form data relating to said distinguishing characteristic of said another coin and to store said data relating to said another coin in said memory structure to thereafter determine whether later inserted coins are genuine another coins.

6. An electronic coin selector comprising:

means for detecting a coin inserted into the selector to obtain data concerning at least one characteristic of the coin to determine if the coin is genuine;

a memory within the selector for storing data including key data which relates to a characteristic of a genuine key in the form of a coin, said key providing access to at least some of the data stored in the memory for re-configuration thereof; and means for comparing the data from the detecting means and key data to determine whether the inserted coin is a key coin.

7. The electronic coin selector of claim 6 including the memory storing coin data which correlates to said characteristic of a genuine coin and means for changing the stored coin data in response to insertion of said key coin.

8. The electronic coin selector of claim 6 further including means for changing the key data stored in the memory.

* * * * *